US006750565B2

(12) United States Patent
Degen et al.

(10) Patent No.: US 6,750,565 B2
(45) Date of Patent: Jun. 15, 2004

(54) METHOD OF SWITCHING ON AN INDUCTIVE LOAD

(75) Inventors: Michael Degen, Bad Homburg (DE); Lothar Erle, Kelkheim (DE)

(73) Assignee: Siemens Aktiengesellschaft, München (DE)

( * ) Notice: Subject to any disclaimer, the term of this patent is extended or adjusted under 35 U.S.C. 154(b) by 231 days.

(21) Appl. No.: 10/043,563

(22) Filed: Jan. 11, 2002

(65) Prior Publication Data

US 2002/0109418 A1 Aug. 15, 2002

(30) Foreign Application Priority Data

Jan. 11, 2001 (DE) ..... 101 00 873

(51) Int. Cl.[7] ..... F02P 3/45

(52) U.S. Cl. ..... 307/131; 123/406.11; 324/391; 702/176

(58) Field of Search ..... 307/131; 123/406.11, 123/406.12, 406.19; 702/64, 65, 79, 125, 176; 701/101, 102, 105; 324/380, 391, 392

(56) References Cited

U.S. PATENT DOCUMENTS

| | | | | | |
|---|---|---|---|---|---|
| 4,198,936 | A | * | 4/1980 | Pagel et al. | 123/609 |
| 4,298,941 | A | * | 11/1981 | Furuhashi | 701/102 |
| 4,303,977 | A | * | 12/1981 | Kobashi et al. | 701/101 |
| 4,347,570 | A | * | 8/1982 | Akiyama et al. | 701/102 |
| 4,479,479 | A | * | 10/1984 | Domland et al. | 123/630 |
| 4,649,888 | A | * | 3/1987 | Kawai et al. | 123/609 |
| 4,913,123 | A | * | 4/1990 | DeBiasi et al. | 123/406.19 |
| 4,933,861 | A | * | 6/1990 | Allen et al. | 701/102 |
| 5,001,645 | A | * | 3/1991 | Williams et al. | 701/102 |
| 5,043,900 | A | * | 8/1991 | Allen et al. | 701/102 |
| 5,144,560 | A | * | 9/1992 | Kurihara et al. | 324/392 |
| 5,156,127 | A | * | 10/1992 | Ghaem | 324/391 |
| 5,157,613 | A | * | 10/1992 | Williams et al. | 701/102 |
| 5,208,540 | A | * | 5/1993 | Hoeflich | 701/102 |
| 5,337,717 | A | * | 8/1994 | Scheel et al. | 123/406.19 |
| 5,383,350 | A | * | 1/1995 | Bennett et al. | 324/391 |
| 5,467,752 | A | * | 11/1995 | Murao et al. | 123/406.6 |
| 6,272,428 | B1 | * | 8/2001 | Heath et al. | 123/406.6 |
| 6,512,375 | B1 | * | 1/2003 | Yamada et al. | 324/391 |
| 6,560,528 | B1 | * | 5/2003 | Gitlin et al. | 701/101 |

FOREIGN PATENT DOCUMENTS

| | | | |
|---|---|---|---|
| DE | 28 33 474 C2 | 2/1980 | F02P/3/045 |
| DE | 34 02 537 C2 | 8/1985 | F02P/3/045 |

* cited by examiner

*Primary Examiner*—Stephen W. Jackson
*Assistant Examiner*—Roberto J Rios
(74) *Attorney, Agent, or Firm*—Cohen, Pontani, Lieberman & Pavane

(57) ABSTRACT

A method for switching on an inductive load, in particular an ignition coil, whose current is intended repeatedly to reach a predefined variable end value at a respectively predefined variable time, includes measuring the time interval between the switching-on action and reaching at least one predefined intermediate value. This time interval and the at least one predefined intermediate value are used to calculate the anticipated time from switching on until the end value is reached. A following switching-on action is carried out at the calculated time before the respectively predefined time.

11 Claims, 1 Drawing Sheet

METHOD OF SWITCHING ON AN INDUCTIVE LOAD

BACKGROUND OF THE INVENTION

1. Field of the Invention

The invention relates to a method of switching on an inductive load, in particular an ignition coil, whose current is intended repeatedly to reach an end value at a specific time.

2. Description of the Related Art

To reach a predefined current at a specific predefined time following the application of a voltage to an inductive load, the action of switching on the load is required to occur at a first time before the predefined time, the first time depending on the slope of the current rise. The slop of the current rise in turn depends on the inductance, the battery voltage, contact resistances and the temperature.

SUMMARY OF THE INVENTION

The object of the present invention is to perform the action of switching on the inductive load such that a current conducted by the load reaches a predefined end value at a predefined time. More specifically, in the electronic ignition of internal combustion engines, a predefined ignition energy is to be ensured which, if necessary, may be varied considerably as a function of operating parameters of the internal combustion engine, just like the ignition time.

According to the present invention, this object is achieved by measuring the time interval between the switching-on of the inductive load and reaching at least one intermediate current value. The measured time interval and the at least one predefined intermediate value are used to calculate the anticipated time interval from switching on the inductive load until the end value is reached. A following switching-on action is carried out at the calculated time interval before the respectively predefined time.

The curve associated with current rise in inductive loads is not a straight line, but has an individual curvature which depends on various influencing variables, such as battery voltage, contact resistances in the cabling and the connectors, resistance changes arising from temperature or aging. Depending on the design, these influencing variables can be controlled out individually by the method according to the invention.

In an embodiment of the present invention, the time is calculated using a function representing the current rise when a substantially constant voltage is applied. The function is preferably stored in a memory. This embodiment allows registration of a current curve which varies with respect to its slope.

To account for changes in the curvature of the current curve, the method according to the invention may be designed such that the function is calculated from a plurality of predefined intermediate values and the times associated with these.

In a further embodiment of the present invention, the measured time interval is used to calculate at least one parameter of a predefined function. In the following switching-on action, the calculated time is determined by using the function, the at least one parameter and the end value.

In this embodiment, provision is preferably made for the function to be $i=\hat{i}(1-e^{-t.R/L})$, i is the current at the time t, $\hat{i}$ is the current reached at infinity, R is the resistance and L is the inductance, and the parameter calculated to be R/L. For example, to determine R/L the inductive load is switched on and the time to reach an intermediate current value is measured. The time to reach the intermediate current value is inserted in place of t in the equation and the intermediate current value is i. The value $\hat{i}$ is measured by measuring the current through the inductive load after a steady state has been reached. From these values, R/L is then calculated in the above equation. The calculated R/L and the desired end value as i may then be used to determine the time duration between the switching-on action and reaching the end value.

The method according to the present invention is preferably performed in the processor of a control device. To avoid complicated calculations, the function may be stored as a table, in each case a time until the predefined intermediate value is reached being assigned to the associated time between the switching-on action and reaching the predefined value.

In yet another embodiment of the present invention, the time between the switching-on action and the anticipated reaching of the end value is calculated in accordance with the rule of three, using a correction value which represents the curvature of the function.

If a change in the curvature of the curve should be negligible in an application, it is further possible, within the scope of the method according to the present invention, for the time between the switching-on action and the anticipated reaching of the end value to be calculated in accordance with the rule of three, i.e., a method of finding a fourth number from three known numbers, of which the first has the same proportion to the second as the third does to the fourth.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
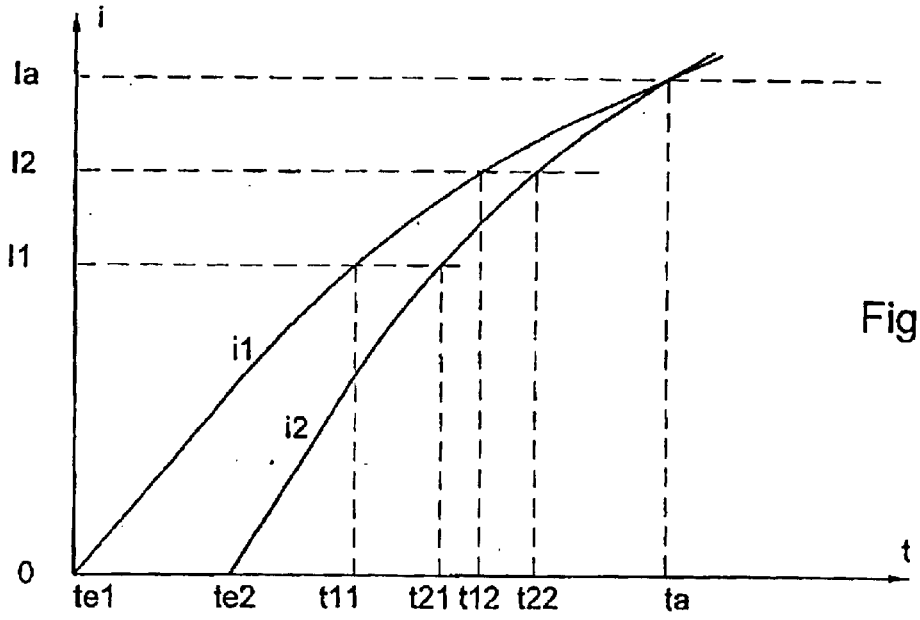
FIG. 1 is a current/time graph used to explain the method according to the present invention.

FIG. 1 is a graph which illustrates the variations in current upon switching on an ignition coil (i.e., the current rise curves of the ignition coil). The ignition coil is intended to have reached the current Ia (end value) at a predefined switch-off time ta. In the presence of different influencing variables, the current rise follows various curves, two of which curves i1 and i2 are illustrated in FIG. 1. The switch-on times of curves i1 and i2 are respectively designated by te1 and te2.

The current curve i1 reaches the first predefined intermediate value I1 at t11, and the second predefined intermediate value I2 at t12. The current curve I2 reaches the intermediate values I1 and I2 correspondingly later, namely at the times t21 and t22.

Figure 2:
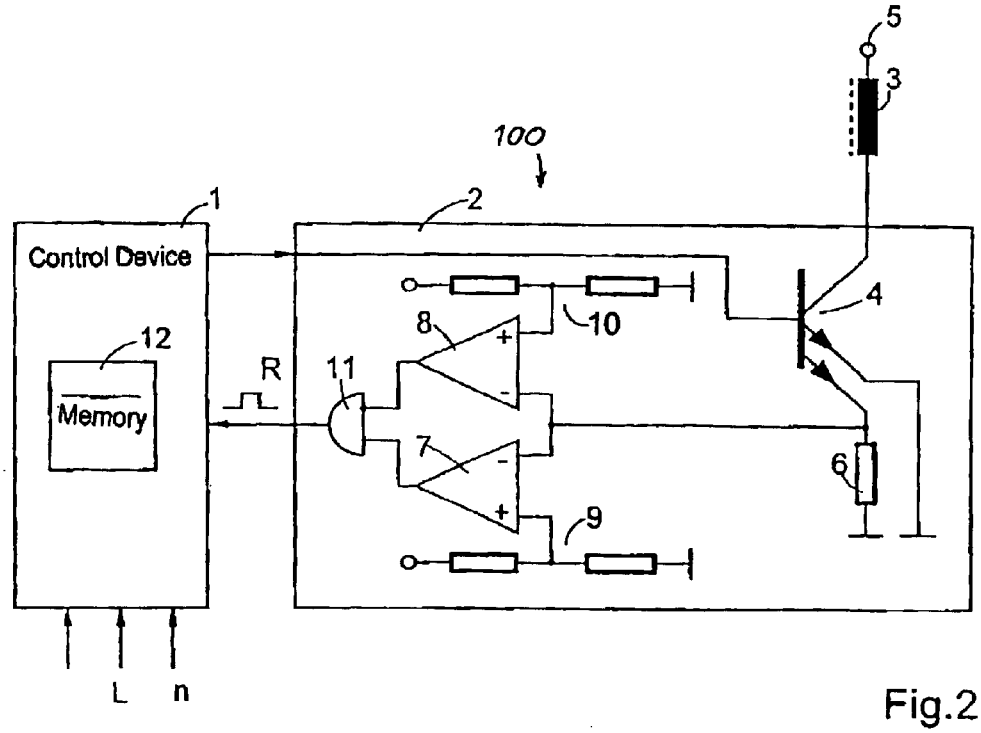
FIG. 2 is a block circuit diagram of a circuit in which the method according to the present invention is performed.

The circuit arrangement 100 according to FIG. 2 shows schematically a control device 1 and the primary winding 3 of an ignition coil, which is connected between a switching transistor 4 of the output stage 2 and an operating voltage terminal 5. The output stage, including the current measuring circuit, can be obtained as a one structural element. The inner wiring is only illustrated to the extent necessary for an understanding of the invention. The control device 1 receives various variables, for example an incremental signal n which contains the rotational speed and the crankshaft angle, and the air quantity L. From these, the respectively most favourable ignition time ta is calculated. The transistor 4 is switched on at the time interval ta−te before this time ta.

However, as already explained in connection with FIG. 1, this time interval is not constant, for which reason, with the aid of the intermediate values and the associated times t11 to t22, the respectively correct switch-on time t1 or t2 is calculated. For this purpose, the current is measured with the aid of a resistor 6, which is connected in series with a further emitter (sensor emitter) of the transistor 4. The voltage corresponding to the current is fed to two comparators 7, 8, to which, via voltage dividers 9, 10, voltages which represent the intermediate values are routed. By linking the output signals from the comparators at 11, a signal R is produced which, when the first intermediate value I1 is reached, rises to a positive level, and falls again when the second intermediate value I2 is reached. Since the intermediate values are given and stored in a memory 12 of the control device, the flanks of the signal R can be used to calculate the respective current variation, and the current can be switched on at the correct time te.

In an embodiment of the present invention, the time interval ta−te for reaching the end current Ia is calculated using a function representing the current rise when a substantially constant voltage is applied. The function is preferably stored in the memory 12. This embodiment allows registration of a current curve which varies with respect to its slope.

To account for changes in the curvature of the current curve, the method according to the invention may be designed such that the function is calculated from a plurality of predefined intermediate values and the times associated with these.

In a further embodiment of the present invention, the measured time interval is used to calculate at least one parameter of a predefined function. The function may also be stored in the memory 12. In the following switching-on action, the calculated time is determined by using the function, the at least one parameter and the end value.

In this embodiment, provision is preferably made for the function to be $i=\hat{i}(1-e^{-t.R/L})$, i is the current at the time t, $\hat{i}$ is the current reached at infinity, R is the resistance and L is the inductance, and the parameter calculated to be R/L. For example, to determine R/L the inductive load is switched on and the time to reach an intermediate current value is measured. The time to reach the intermediate current value is inserted in place of t in the equation and the intermediate current value is i. The value $\hat{i}$ is measured by measuring the current through the inductive load after a steady state has been reached. From these values, R/L is then calculated in the above equation. The calculated R/L and the desired end value as i may then be used to determine the time duration between the switching-on action and reaching the end value.

The method according to the present invention is preferably performed in a processor of the control device 1. To avoid complicated calculations, the function may be stored as a table, in each case a time until the predefined intermediate value is reached being assigned to the associated time between the switching-on action and reaching the predefined value.

In yet another embodiment of the present invention, the time between the switching-on action and the anticipated reaching of the end value is calculated in accordance with the rule of three, using a correction value which represents the curvature of the function.

If a change in the curvature of the curve should be negligible in an application, it is further possible, within the scope of the method according to the present invention, for the time between the switching-on action and the anticipated reaching of the end value to be calculated in accordance with the rule of three, i.e., a method of finding a fourth number from three known numbers, of which the first has the same proportion to the second as the third does to the fourth.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method of switching on an inductive load, a current of which is intended to repeatedly reach an end current value at desired time, comprising the steps of:

a. measuring a time interval between a switching on time of the inductive load and a time that at least one intermediate current value of the current through the inductive load is reached;

b. using the time interval measured in said step a. and the at least one intermediate current value to calculate an end current time interval from the switching-on time until the end current value is reached; and c. performing a switching-on of the inductive load at the end current time interval before the desired time.

2. The method of claim 1, wherein said step b. comprises using a function representing the rate of current rise in the inductive load when a constant voltage is applied for calculating the end current time interval.

3. The method of claim 2, wherein said step b. includes querying a memory for determining the function representing the rate of current rise.

4. The method of claim 2 wherein said step b. includes calculating the function representing the rate of current rise from at least one intermediate current value and the time interval between a switching-on time and the time at which at least one intermediate current valve is reached.

5. The method of claim 1, where said step b. comprises using the time interval measured in said step a. to calculate at least one parameter of a function and using the function, the at least one parameter and the end current valve to calculate the end current time interval.

6. The method of claim 5, wherein the function used in step b. comprises:

$$i=\hat{i}(1-e^{-t.R/L})$$

wherein:

i is the current at a time t;

$\hat{i}$ is the current reached at infinity;

R is the resistance; and

L is the inductance.

7. The method of claim 2, wherein the function used in said step b. is stored as a table including a plurality of intermediate current values assigned to corresponding values of end current time intervals.

8. The method of claim 3, wherein the function used in said step b. is stored as a table including a plurality of intermediate current values assigned to corresponding values of end current time intervals.

9. The method of claim 4, wherein the function used in said step b. is stored as a table including a plurality of intermediate current values assigned to corresponding values of end current time intervals.

10. The method of claim 2, where step b. further includes determining a correction value representing a curvature of the function and calculating the end current time interval in accordance with the rule of three using the correction value.

11. The method of claim 1, wherein said step b. comprises calculating the end current time interval in accordance with the rule of three.

* * * * *